US007385437B2

(12) United States Patent
Dreps et al.

(10) Patent No.: US 7,385,437 B2
(45) Date of Patent: Jun. 10, 2008

(54) DIGITALLY TUNABLE HIGH-CURRENT CURRENT REFERENCE WITH HIGH PSRR

(75) Inventors: Daniel Mark Dreps, Georgetown, TX (US); Norman Karl James, Liberty Hill, TX (US); Hector Saenz, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 250 days.

(21) Appl. No.: 11/055,840

(22) Filed: Feb. 11, 2005

(65) Prior Publication Data

US 2006/0181337 A1 Aug. 17, 2006

(51) Int. Cl.
*G05F 1/10* (2006.01)
*G05F 3/02* (2006.01)

(52) U.S. Cl. ..... 327/539

(58) Field of Classification Search ..... 327/53, 327/66, 512–513

See application file for complete search history.

(56) References Cited

U.S. PATENT DOCUMENTS 5,309,296 A * 5/1994 Nagase et al. ..... 360/66
5,900,749 A * 5/1999 Hendrickson et al. ..... 327/96
6,304,201 B1 * 10/2001 Moreland et al. ..... 341/154
6,437,610 B1 * 8/2002 Schrodinger ..... 327/108
6,737,909 B2 * 5/2004 Jaussi et al. ..... 327/541
6,847,240 B1 * 1/2005 Zhou ..... 327/143
7,049,986 B1 * 5/2006 Jones ..... 341/121
7,095,347 B2 * 8/2006 Hirata et al. ..... 341/144
7,170,274 B2 * 1/2007 Mukherjee et al. ..... 323/313
2002/0036536 A1 * 3/2002 Wada et al. ..... 327/538

* cited by examiner

*Primary Examiner*—Quan Tra
(74) *Attorney, Agent, or Firm*—Duke W. Yee; Matthew W. Baca; Lisa L. B. Yociss

(57) ABSTRACT

A digitally tunable low voltage CMOS current reference is disclosed. A tunable current reference circuit is provided that includes a current source circuit that is coupled to a power supply voltage. The current source circuit provides a stable current reference output regardless of fluctuations in the power supply voltage. Multiple digitally selectable inputs are included in the current reference circuit and are coupled to the current source circuit. These inputs are used to adjust a value of the current reference output.

10 Claims, 2 Drawing Sheets

Measured PSRR

Decibels

Frequency (GHz)

DIGITALLY TUNABLE HIGH-CURRENT CURRENT REFERENCE WITH HIGH PSRR

BACKGROUND OF THE INVENTION

1. Technical Field

The present invention is directed to a current reference. Still more specifically, the present invention is directed to a low voltage CMOS current reference that is digitally tunable and that provides a high power supply rejection ratio (PSRR).

2. Description of Related Art

Technology improvements in semiconductor processing have led to a substantial increase in the number of transistors fabricated on a single integrated circuit. Along with an increase in the number of transistors also comes an increase in the amount of power dissipated by the integrated circuit. In an effort to reduce power dissipation (or power consumption), designers have reduced the voltage level of the power supplies in such integrated circuits. Currently for 65 nm and beyond the CMOS Vdd rail is reaching an asymptote of 1.2-0.8V.

Some circuit applications require a current reference that has a good power supply rejection ratio (PSRR), that is small in area, and capable of supplying large currents. Many of the current implementations use diodes, which in typical digital CMOS processes can only operate on the order of 20 microamps. These diodes have a large voltage drop on the order of 0.7 to 0.8V. This limits the voltage scaling and a special higher voltage rail would be required on an ASIC or processor.

Therefore, a need exists for a digitally tunable, high current, CMOS current reference with reduced sensitivity to power supply voltage fluctuations that can operate at current generation CMOS power supply levels.

SUMMARY OF THE INVENTION

A digitally tunable low voltage CMOS current reference is disclosed. A tunable current reference circuit is provided that includes a current source circuit that is coupled to a power supply voltage. The current source circuit provides a stable current reference output regardless of fluctuations in the power supply voltage. Multiple digitally selectable inputs are included in the current reference circuit and are coupled to the current source circuit. These inputs are used to adjust a value of the current reference output.

The above as well as additional objectives, features, and advantages of the present invention will become apparent in the following detailed written description.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE PREFERRED EMBODIMENT

A preferred embodiment of the present invention and its advantages are better understood by referring to the figures, like numerals being used for like and corresponding parts of the accompanying figures.

The present invention is a digitally tunable high-current current reference that has a high PSRR. The present invention provides a stable current reference that is independent of possible fluctuations in the power supply voltage. The value of the current reference is digitally selectable using a plurality of different selectable settings in the circuit.

Figure 1:
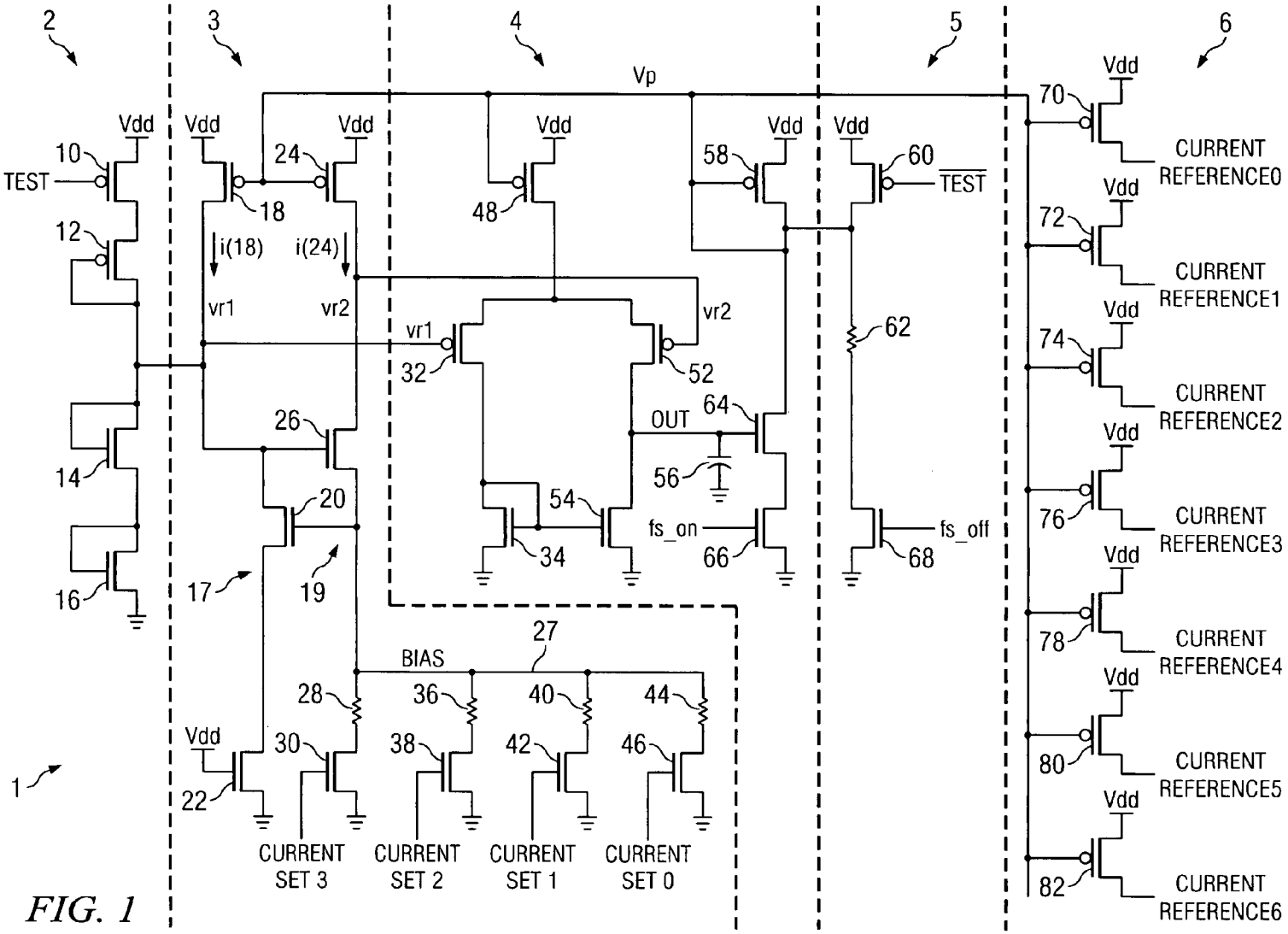
FIG. 1 is a schematic diagram of a digitally tunable high-current current reference with high PSRR in accordance with the present invention.

FIG. 1 is a schematic diagram of a digitally tunable high-current current reference with high PSRR in accordance with the present invention.

The current reference of the present invention uses an n-channel FET (Nfet) threshold voltage based reference so the current is proportional to the Nfet threshold voltage divided by a selected shunt resistor. The shunt resistors are depicted as resistors 28, 36, 40, and 44.

The Nfet threshold voltage Vt is, generally, the gate electrode to source electrode voltage at which a channel forms between the drain and source electrodes of the FET to allow appreciable current to flow. The threshold voltage of the devices of circuit 1, including the threshold voltage of device 20, changes with the process variation with respect to device channel length of the particular devices that have been selected to be used to implement circuit 1, the operating temperature of circuit 1, and any change in the power supply voltage Vdd. Because the Nfet threshold voltage in any CMOS process is variable, the current can widely vary. Thus, to be effective the current reference must be digitally trimmed.

The circuit is physically small with the area of the circuit being dominated by the stability capacitor.

Figure 2:
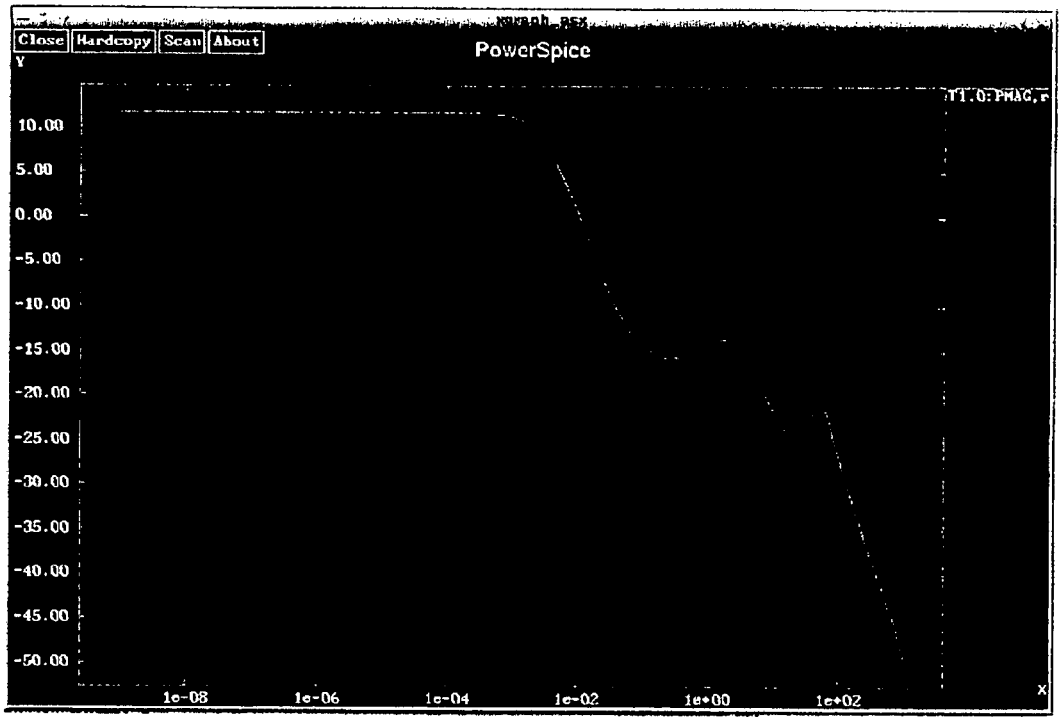
FIG. 2 depicts the measured PSRR of the circuit of FIG. 1 where decibels are shown on the y-axis and frequency in GHZ is shown on the x-axis in accordance with the present invention.

A PSRR of −20 db at 1 GHz, as shown in FIG. 2, can be achieved with the base current set to 1 milliamp in a 65 nanometer CMOS bulk and CMOS_SOI (silicon on insulator) technology. This circuit will work properly down to 0.8 volts.

Circuit 1 includes a start up stage 2, a current source stage 3, a differential amplifier and feedback stage 4, a failsafe stage 5, and an output stage 6.

Start up stage 2 is provided to make sure the rest of circuit 1 is operating in a normal operating mode. Current source stage 3 provides a pair of current signals that are generated using a threshold voltage of a particular CMOS device included in current source stage 3. Differential amplifier and feedback stage 4 is provided to make sure the pair of current signals through devices 18 and 24 continue to match each other and remain equal to one another regardless of possible fluctuations in the power supply voltage. Output stage 6 provides the current references as outputs from circuit 1.

Start up stage 2 includes p-channel FET 10, p-channel FET 12, n-channel FET 14, and n-channel FET 16. The source of device 10 is coupled to the power supply voltage Vdd. The gate of device 10 receives as an input a "test" signal. The drain of device 10 is coupled to the source of device 12. The gate and drain of device 12 are coupled together and to the source and gate of device 14 and to a source of device 20. The drain of device 14 is coupled to the source and gate of device 16. The drain of device 16 is coupled to ground.

Start up circuit 2 provides a start up function to the rest of circuit 1. There are two valid operating points for the remainder of the circuit 1, one at zero voltage, or ground, and one at some particular voltage level Vp. Start up circuit 2 provides an input to a current source circuit 3.

Current source circuit 3 includes a current mirror. The current mirror includes a source leg 17 which includes p-channel FET 18 and n-channel MOSTFET 20. The current mirror includes a mirror leg 19 which includes p-channel FET 24 and n-channel FET 26.

The sources of devices 18 and 24 are coupled to the power supply voltage Vdd. The gates of devices 18 and 24 are coupled to the signal Vp. The drain of device 18 is coupled to a gate of device 32, a gate of device 26, and a source of device 20. A current i(18) flows out from the drain of device 18.

The drain of device 24 is coupled to a gate of device 52 and a source of device 26. A current i(24) flows out from the drain of device 24.

The drain of device 20 is coupled to a source of device 22. The gate of device 22 is coupled to the power supply voltage. The drain of device 22 is coupled to ground.

The drain of device 26 is coupled to the gate of device 20 and a first end of resistors 28, 36, 40, and 44. The signal at this node, bias 27, is referred to herein as the bias signal.

A second end of resistor 28 is coupled to a source of device 30. A gate of device 30 is coupled to a current set signal 3. A drain of device 30 is coupled to ground. Current set signal 3 is preferably driven by a latch such that the current set signal is either ground or Vdd depending on the output of the latch. When current set signal 3 is selected, the value of the signal will be the power supply voltage. Otherwise, the value will be ground when the signal is not selected.

A second end of resistor 36 is coupled to a source of device 38. A gate of device 38 is coupled to a current set signal 2. A drain of device 38 is coupled to ground. Current set signal 2 is preferably driven by a latch such that the signal is either ground or Vdd depending on the output of the latch. When current set signal 2 is selected, the value of the signal will be the power supply voltage. Otherwise, the value will be ground when the signal is not selected.

A second end of resistor 40 is coupled to a source of device 42. A gate of device 42 is coupled to a current set signal 1. A drain of device 42 is coupled to ground. Current set signal 1 is preferably driven by a latch such that the signal is either ground or Vdd depending on the output of the latch. When current set signal 1 is selected, the value of the signal will be the power supply voltage. Otherwise, the value will be ground when the signal is not selected.

A second end of resistor 44 is coupled to a source of device 46. A gate of device 46 is coupled to a current set signal 0. A drain of device 46 is coupled to ground. Current set signal 0 is preferably driven by a latch such that the signal is either ground or Vdd depending on the output of the latch. When current set signal 0 is selected, the value of the signal will be the power supply voltage. Otherwise, the value will be ground when the signal is not selected.

Devices 30, 38, 42, and 46, and resistors 28, 36, 40, and 44 are referred to herein as a current trim circuit.

Differential amplifier and feedback stage 4 includes a differential amplifier that includes p-channel FET 48, p-channel FET 32, p-channel FET 52, n-channel FET 34, and n-channel FET 54. The differential amplifier receives voltage signals vr1 and vr2 and generates an output signal "out" when the two voltage signals are not equal.

Differential amplifier and feedback stage 4 includes a stabilizing capacitor 56 that keeps the differential amplifier from oscillating and provides a high frequency path into the rest of the feedback loop to improve the PSRR at higher frequencies.

The feedback loop in feedback stage 4 has a high bandwidth i.e. it can detect both high and low frequencies, so it can recover from power supply fluctuations quickly. Thus, circuit 1 provides a high PSRR.

The source of device 48 is coupled to the power supply voltage. The gate of device 48 receives Vp as its input signal. The drain of device 48 is coupled to the sources of devices 32 and 52. The drain of device 32 is coupled to the source of device 34 and the gates of devices 34 and 54. The drain of device 34 is coupled to ground. The drain of device 52 is coupled to the source of device 54 and a first end of capacitor 56 and the gate of device 64. This node that includes the drain of device 52, the source of device 54, a first end of capacitor 56, and the gate of device 64 is referred to herein as the "out" signal. A second end of capacitor 56 is coupled to ground.

The source of device 58 is coupled to the power supply voltage Vdd. The gate and drain of device 58 are coupled to Vp, the drain of device 60, a first end of resistor 62, and the source of device 64. The drain of device 64 is coupled to the source of device 66. The gate of device 66 receives as an input a signal, "fs_on". The drain of device 66 is coupled to ground.

Feedback loop includes n-channel FET 66, n-channel FET 64, and p-channel FET 58. The p-channel FET 58 also performs a function in failsafe stage 5 although it is depicted only in stage 4.

The source of device 60 is coupled to the power supply voltage Vdd. The gate of device 60 receives as an input a signal "not-test" that is the complement of the "test" signal that is input into the gate of device 10.

The drain of device 60 is coupled to the drain of device 58, the gate of device 58, Vp, and a first end of resistor 62. The second end of resistor 62 is coupled to the source of device 68. The gate of device 68 receives as an input a signal, "fs_off". Signal "fs_off" is the complement of the "fs_on" signal that is input into the gate of device 66. The drain of device 68 is coupled to ground.

Output stage 6 includes multiple p-channel FETs 70, 72, 74, 76, 78, 80, and 82 that receive a voltage Vp input into the gate of each p-channel FET. In response, these p-channel FETs generate a current reference that is a known value that does not vary regardless of fluctuations in the supply voltage. The values of each current reference output signal is selectable by selecting a particular current set signal.

Devices 70, 72, 74, 76, 78, 80, and 82 receive as an input into their gates the voltage Vp input signal. The sources of each of devices 70, 72, 74, 76, 78, 80, and 82 are coupled to the power supply voltage Vdd. The drains of each device 70, 72, 74, 76, 78, 80, and 82 are provided as a current reference signal.

Thus, the drain of device 70 is provided as current reference signal 0. The drain of device 72 is provided as current reference signal 1. The drain of device 74 is provided as current reference signal 2. The drain of device 76 is provided as current reference signal 3. The drain of device 78 is provided as current reference signal 4. The drain of device 80 is provided as current reference signal 5. The drain of device 82 is provided as current reference signal 6.

In a start up mode, the signal "test" will be Vdd. Thus, the signal "not test" will be ground. The current reference signals 0-6 will be zero. The purpose of the stage up mode is to properly transition stages 3, 4, and 5 into a normal operating mode. During the start up mode, current is forced through devices 10 and 12 into devices 20 and 22 and then to ground. The start up stage 2 ensures that circuit 1 goes from ground to an operating point.

In a normal operating mode, the signal "test" will be ground and the signal "not test" will be Vdd. At this time, the voltage Vp will become an operating value that is dependent on the threshold voltage of device 20. Therefore, once in a normal operating mode, a threshold voltage of device 20 is used to generate the current references 70-82.

The differential amplifier that includes devices 48, 32, 52, 34, and 54 has two valid operating points, one at ground and one at the current of the regulated loop which includes all of the devices in stages 3 and 4.

Stage 3 is a current source that is based on the threshold voltage of device 20. A bias signal is provided at the node, bias 27, that includes the first ends of resistors 28, 26, 40, 44, the gate of device 20, and the drain of device 26. The value of the bias signal can be adjusted by turning on selected current set signals 0-3.

According to a preferred embodiment, four current set signals are depicted. Only one of the signals, current set signals 0-3, is turned on at any one time. Those skilled in the art will recognize that any number of current set signals, other than four, can be provided and used. Further, those skilled in the art will also recognize that more than one of these signals can be turned on and used at any one time.

The value of the bias signal is adjusted by selecting one of the current set signals 0-3 to turn on. By selecting one of these current set signals, the magnitude of the current reference signals 0-6 can be adjusted to compensate for process variations and to provide a larger dynamic range of current adjustment.

The currents through devices 18 and 24, i.e. i(18) and i(24) respectively, are equal. The current through device 24, i(24), flows through device 26 and through the register and n-channel device that has been selected to be turned on. For example, current set signal 1 may have been selected and is turned on. In this case, current set signals 0 and 2-3 are not selected and are turned off. Therefore, the current i(24) will flow through device 24, through device 26, and then through resistor 40 and device 42. Current will not flow through resistors 28, 36, or 44 or through devices 30, 38, or 44 because their respective current set signals 3, 2, and 0 have not been selected by being set equal to the power supply voltage Vdd.

A fixed current i(18) flows after the start up mode has completed. The current i(18) causes a voltage bias on vr1 which provides the gate bias for device 26. This causes current i(24) to flow. Because devices 18 and 24 are matched to each other, and devices 20 and 26 are matched to each other, the currents i(18) and i(24) will ideally be equal to each other. This causes vr1 and vr2 to also be equal. The signals vr1 and vr2 drive the inputs on the differential amplifier and feedback stage 4 by being inputs into devices 32 and 52, respectively.

The gate of device 20 is being driven by the value of bias node 27. When i(18) starts flowing, the whole circuit 1 turns on. This signal vr1 then drives the gate on device 26 which then starts up. At this time, current i(24) starts flowing which causes current to flow through the devices of the selected current set signal. Thus, if current set signal 2 is selected, current flows through devices 36 and 38. This, then, causes a bias on the gate of device 20.

One of the current set signals is selected based on the desired value of the current reference signals. The amount of current that flows through source current stage 3 will determine how much current is output from output stage 6 as the current reference signals. The value of the current reference signals 0-6 is adjustable depending on which current set signal is selected.

One of the current set signals 0-3 may be selected. When one of the current set signals is selected, the resistor that is coupled to that signal is selected. For example, resistor 44 is associated with current set signal 0. Resistor 40 is associated with current set signal 1. Resistor 36 is associated with current set signal 2. Resistor 28 is associated with current set signal 3.

The current that is flowing through source current stage 3, i.e. currents i(18) and i(24), is proportional to the size of the resistor that is selected. When current set signal 0 is selected, resistor 44 is selected so that currents i(18) and i(24) will be approximately equal to the threshold voltage of device 20 (Vt) divided by the value of resistor 44. When current set signal 1 is selected, resistor 40 is selected so that currents i(18) and i(24) will be approximately equal to the threshold voltage of device 20 (Vt) divided by the value of resistor 40. When current set signal 2 is selected, resistor 38 is selected so that currents i(18) and i(24) will be approximately equal to the threshold voltage of device 20 (Vt) divided by the value of resistor 38. When current set signal 3 is selected, resistor 28 is selected so that currents i(18) and i(24) will be approximately equal to the threshold voltage of device 20 (Vt) divided by the value of resistor 28.

Because the value of the current reference signals are controlled by the values of currents i(18) and i(24), the value of the current reference signals can be adjusted by selecting a particular current set signal 0-3. These current set signals are driven by a latch and thus are digitally selectable.

Failsafe stage 5 operates to make sure that circuit 1 is producing a current in the event that stages 2, 3, and 4 (with the exception of device 58 which operates in both stages 4 and 5) have failed.

In a normal operating mode, the signal fs_on input into the gate of device 66 is the power supply voltage Vdd. Thus, the signal fs_off input into the gate of device 68 is ground in the normal mode. Therefore, device 68 is turned off and device 66 is turned on. Normally, current flows from device 58 to device 64 to device 66 to ground.

In a failsafter mode, fs_on is ground and fs_off is the power supply voltage. Device 66 is then turned on and device 68 is turned off. This will cause some current to flow from device 58 to device 62 to device 68 to ground. Thus, in the failsafter mode, current will flow through device 62 which will set a bias current through device 68. This will set up a bias current to put a bias on node Vp on gate of nodes 70 and 58 and current will flow out of current reference 0 to produce some function.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A tunable current reference circuit, said circuit comprising:

a current source circuit coupled to a power supply voltage, said current source circuit providing a stable current reference output regardless of fluctuations in said power supply voltage;

a start up stage, a current source stage, a differential amplifier and feedback stage, a failsafe stage, and an output stage;

said start up stage for causing said current source stage, said differential amplifier and feedback stage, and said failsafe stage to operate at a non-ground operating voltage;

a plurality of digitally selectable inputs coupled to said current source circuit for selectively adjusting a value of said current reference output;

said current source circuit including an externally biased current mirror that outputs a first current and a second current;

said externally biased current mirror biased by a differential amplifier and feedback circuit, which is external to said externally biased current mirror;

inputs into said differential amplifier and feedback circuit being a first voltage and a second voltage, which are proportional to said first current and second current, respectively;

said differential amplifier and feedback circuit keeping said first current and said second current equal;

said current source circuit including a current trim circuit;

said current mirror including a first leg and a second leg;

said current trim circuit including said plurality of selectable inputs;

said current trim circuit coupled to said second leg;

each one of said plurality of selectable inputs including a different resistor;

said current reference output derived from a threshold voltage of a CMOS transistor that is included in said first leg;

said start up stage including first, second, third, and fourth transistors;

wherein a source of said first transistor is coupled to said power supply voltage, a gate of said first transistor receives as an input a test signal, a drain of said first transistor is coupled to a source of said second transistor, a gate and drain of said second transistor are coupled together and to a drain of said CMOS transistor and drain and gate of said third transistor, a source of said third transistor is coupled to a drain and gate of said fourth transistor, and a source of said fourth transistor is coupled to ground; and said stable current reference output proportional to said first current and said second current.

2. The current reference circuit according to claim 1, further comprising:

said plurality of selectable inputs for adjusting an operation of said current reference circuit in response to changing process variations.

3. The current reference circuit according to claim 2, further comprising:

said plurality of selectable inputs for adjusting an operation of said current reference circuit in response to a change in an operating temperature of said current reference circuit.

4. The current reference circuit according to claim 2, further comprising:

said plurality of selectable inputs for adjusting an operation of said current reference circuit in response to a device channel length of devices that are used to implement said current reference circuit.

5. The current reference circuit according to claim 1, further comprising:

said current reference circuit requiring a small silicon area.

6. The current reference circuit according to claim 1, further comprising:

said current reference circuit not requiring a special power rail.

7. The current reference circuit according to claim 1, further comprising:

said current reference output proportional to said threshold voltage divided by a value of a resistor that is included in a selected one of said plurality of selectable inputs.

8. The current reference circuit according to claim 1, further comprising:

said differential amplifier and feedback circuit including:

a feedback circuit that adjusts said externally biased current mirror in response to fluctuations in said power supply voltage.

9. The current reference circuit according to claim 1, further comprising:

said current source stage including said current source circuit;

said differential amplifier stage including said differential amplifier and feedback circuit;

said failsafe stage for providing a failsafe current in response to a failure of said start up stage, said current source stage, and said differential amplifier and feedback stage; and said output stage for outpurting either said stable current reference output or said failsafe current reference output.

10. The current reference circuit according to claim 9, further comprising:

said current source stage including said current trim circuit; and said current source stage including said current source circuit.

* * * * *